United States Patent [19]

Scholz

[11] Patent Number: 5,015,156

[45] Date of Patent: May 14, 1991

[54] AIRCRAFT FUEL PUMP

[76] Inventor: Daniel E. Scholz, 3343 Jaycox Rd., Avon, Ohio 44011

[21] Appl. No.: 368,491

[22] Filed: Jun. 19, 1989

[51] Int. Cl.[5] ..... F04B 39/06

[52] U.S. Cl. ..... 417/370; 417/423.3

[58] Field of Search ..... 417/369, 370, 423.3, 417/423.8

[56] References Cited

U.S. PATENT DOCUMENTS

| | | | |
|---|---|---|---|
| 2,460,371 | 2/1949 | Szwargulski | 417/369 |
| 2,510,632 | 6/1950 | Hemphill | 417/369 X |
| 2,885,962 | 5/1959 | Campbell | 417/370 X |
| 3,126,030 | 3/1964 | Stoermer | 417/370 X |
| 3,294,025 | 12/1966 | Niemeyer et al. | 417/370 X |
| 3,443,519 | 5/1969 | White . | |
| 3,960,467 | 6/1976 | Zsuppan . | |
| 4,571,159 | 2/1986 | Beardmore . | |
| 4,682,936 | 7/1987 | Suzuki et al. . | |

*Primary Examiner*—John C. Fox

*Attorney, Agent, or Firm*—Ralph E. Jocke

[57] ABSTRACT

An aircraft fuel pump (10) capable of running dry for extended periods of time without sustaining damage includes a housing (12). The housing is divided into a first fluid chamber (31), and a second fluid chamber (73). An impeller (26) is mounted for rotational movement in the first chamber. The impeller is mounted in connection with an armature (76) housed within the second chamber. A fluid passage (38) connects the first and second chambers. A check valve (40) is positioned at an upper end of the passageway in the second chamber. The housing also includes a fuel inlet (18) in communication with the first chamber, a fluid outlet (71) from the second chamber and a pump discharge (32) from which fuel is supplied to the remainder of an aircraft fuel system. In operation fluid from the tank fills the inlet and is moved upward by the action of the impeller. Most of the fluid passes through the pump discharge to the remainder of the fuel system, however some fuel travels through the passageway and check valve into the second chamber. The fluid flow through the second chamber cools the components located therein. The fuel then passes through the fluid outlet which is located at the uppermost portion of the housing. When fuel is depleted from the tank in which the pump is mounted, the check valve holds fuel in the second chamber enabling the pump to run dry for extended periods.

10 Claims, 2 Drawing Sheets

AIRCRAFT FUEL PUMP

TECHNICAL FIELD

This invention relates to fuel pumps. Specifically this invention relates to fuel pumps used in certain types of aircraft that are required to run dry for extended periods of time.

BACKGROUND ART

Certain types of pumps employ a wet motor design in which some of the fluid being pumped is passed through a motor chamber to cool and lubricate the motor. Examples of such pumps are shown in U.S. Pat. Nos. 4,682,938 and 3,443,519. Another design is shown in U.S. Pat. No. 4,571,159. The pump shown in this patent includes a bladder which damps pressure and fluid flow variations.

Wet motor pumps are often used in aircraft applications. In many of these pumps a portion of the aircraft fuel is passed through the motor housing and either returned to the fuel tank or delivered to the engines. In many cases, multiple fuel tanks are used and a wet motor fuel pump is positioned in each tank. These fuel pumps run simultaneously while the aircraft is in operation.

The fuel level drops below the fuel inlet of the fuel pump when the fuel in the tank is used up. As fuel no longer passes through the motor cavity, the motor runs dry and the pump begins to heat up. The pump may be damaged unless fuel is restored or the pump is shut off.

To avoid damage due to overheating in the run dry condition, certain prior art pumps incorporate a thermal switch. The thermal switch shuts off electrical power to the pump when the temperature exceeds a set limit. The thermal switch restores electricity to run the pump only after the temperature drops below a safe limit. Thermal switches, however, have drawbacks in that they are expensive, bulky and add weight to the pump. They also limit the amount of electrical current that can be passed through the motor. Resetable thermal switches also present a possible area for pump failure.

Another type of aircraft pump employs a non-resetable thermal fuse which cuts off electricity to the pump once a set temperature is exceeded. While thermal fuses are smaller, more reliable and less expensive than resetable thermal switches, they must be replaced once they are tripped. This results in down time and labor expense.

Other approaches have been taken to extend the run dry capability of pumps. The pump shown in U.S. Pat. No. 3,960,467 provides for air flow through the pump housing once the fuel supply is used up. The flow of air helps to cool the internal components of the housing when the pump is in a run dry condition. It is doubtful that such a system could be successful when the pump is enclosed within a fuel tank.

Thus, there exists the need for a fuel pump that can run dry for extended periods of time without reaching a temperature that may cause damage to the pump.

DISCLOSURE OF THE INVENTION

It is an object of the present invention to provide a wet pump and motor combination that can run dry for extended periods of time without overheating.

It is a further object of the present invention to provide a fuel pump which is smaller in size than units with resetable thermal switches.

It is further object of the present invention to provide a fuel pump that is more reliable than existing pumps.

It is a further object of the present invention to provide a fuel pump that can be run dry for longer periods of time and more often without damage.

It is a further object of the present invention to provide a fuel pump which can run at a higher current flows than existing pumps.

Further objects of the present invention will be made apparent in the following Best Mode for Carrying Out Invention and the appended claims.

The foregoing objects are accomplished by a pump which includes a housing. The housing has a fluid inlet. The inlet of the pump is connected to a container holding a supply of fuel and in the preferred embodiment of the invention is mounted in the fuel tank of an aircraft. The housing also includes a pump discharge for supplying fuel to a fuel line or other conduit connected to the remainder of the aircraft fuel system. The housing also includes a fluid outlet at its uppermost point. The outlet is in fluid connection with the interior of the tank to enable fuel that is passed from the outlet to recirculate.

The housing also includes a first internal chamber in fluid connection with the inlet and a second internal chamber. The second chamber is positioned vertically above the first chamber and is in fluid connection with the outlet. The pump housing also includes a passageway for passing fluid from the first chamber to the second chamber. The passageway has a first end adjacent the first chamber and a second end adjacent the second chamber.

A rotating armature is located in the second chamber. The fluid outlet is located vertically above the armature. The armature is connected to a rotatable shaft which extends from the second chamber into the first chamber. An impeller is mounted for rotational movement in the first chamber and mounted on the shaft. The first chamber is constructed so that upon rotation of the impeller, fluid is moved from the inlet and delivered under high pressure at the pump discharge and at the fluid passageway. Fluid flows into the passageway and into the second chamber to cool the armature and other components located therein.

A check valve is positioned at the second end of the fluid passageway. The check valve enables fluid to flow from the first chamber to the second chamber but prevents flow in the opposite direction.

During normal operation fluid is available at the pump inlet. Fluid passes from the inlet into the first chamber where the action of the impeller raises it to a higher pressure. Fluid then flows through the passageway and the check valve into the second chamber. Fuel in the second chamber is pushed out the outlet at the top of the pump housing and back into the tank. The flow of fuel through the second chamber cools and lubricates the components therein.

When fuel is no longer available at the inlet, the impeller no longer has fluid available to pump and the pressure in the first chamber drops. This causes the check valve in the passageway to close holding fuel in the second chamber. The fluid held in the second chamber absorbs heat generated by the armature and other mechanical and electrical components. This keeps the motor cool for extensive periods of time particularly when the fuel being pumped has a high specific heat. If the fluid in the second chamber reaches a sufficient temperature, the fuel will vaporize and pass out the fluid outlet carrying away further heat.

As the fuel pump of the present invention may be run dry for extended periods of time without sustaining damage, thermal fuses may be used in lieu of a resetable thermal switch. Thermal fuses may pass greater amounts of current to the pump. This enables the pump to operate at higher current flows and to be smaller in size than other pumps which pass comparable amounts of fuel.

BEST MODE FOR CARRYING OUT INVENTION

Figure 1:
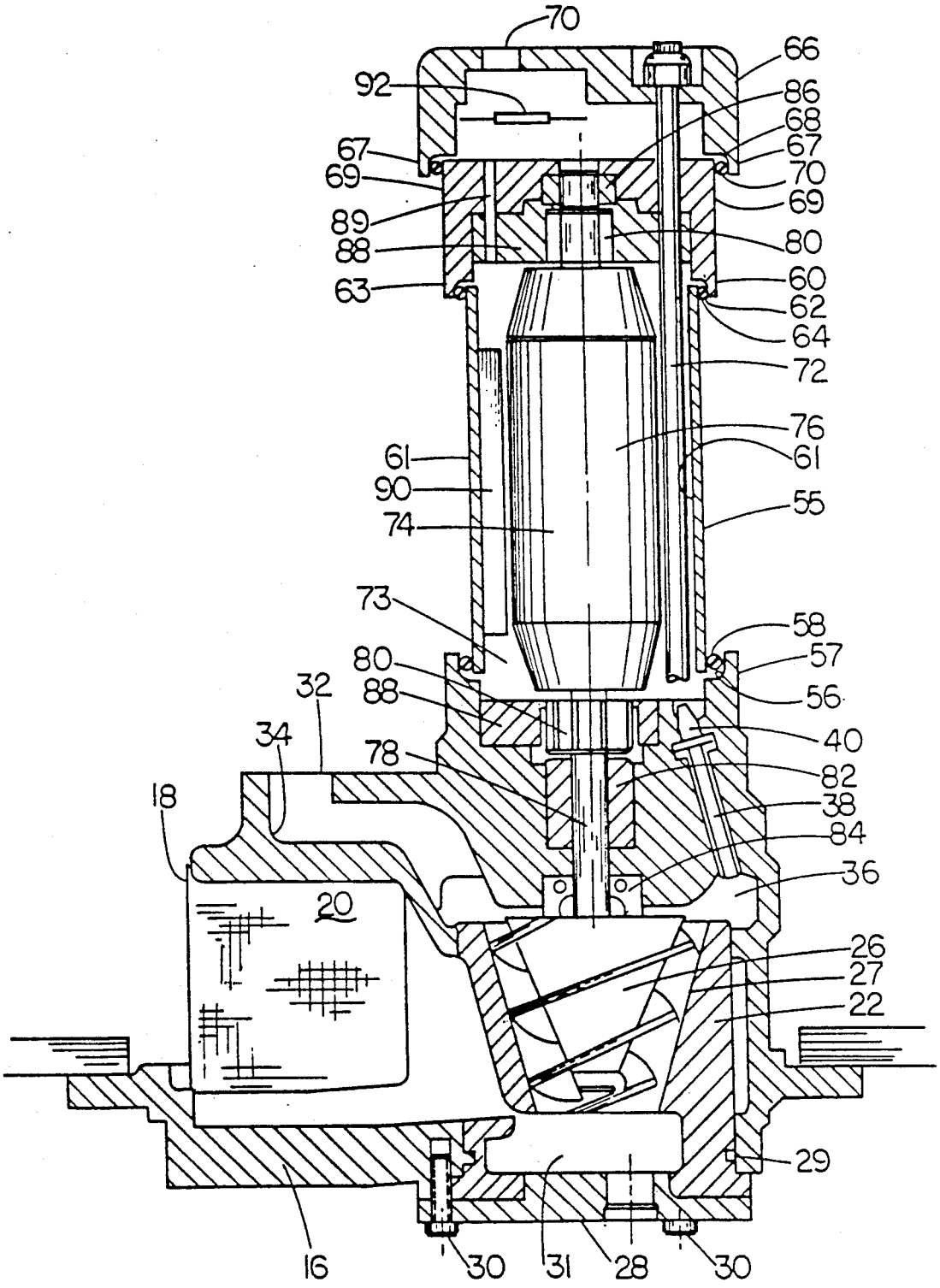
FIG. 1 is a schematic cross sectional view of the preferred embodiment of the aircraft fuel pump of the present invention.

Referring now to the drawings and particularly to FIG. 1, there is shown therein a cross sectional view of the preferred embodiment of the aircraft fuel pump of the present invention generally indicated 10. Pump 10 includes a housing 12 which is comprised of several assembled sections. Housing 12 is mounted on a lower wall 14 of an aircraft fuel tank. The pump is held to the fuel tank in a fluid tight relation by fastening means (not shown).

Housing 12 includes a lower main pump casting 16. Main pump casting 16 includes a fluid inlet 18 which is covered by a screen 20. Screen 20 prevents dirt and other impurities from entering the pump. Housing 12 also includes an impeller sleeve casting 22. Impeller sleeve casting 22 includes a generally conical center bore 24 which surrounds an impeller 26 which is rotatable therein. Housing 12 also includes a pump end plate 28 which is mounted underneath impeller sleeve casting 22. End plate 28 and impeller sleeve casting 22 are held to lower main casting 16 by fasteners represented by bolts 30 in FIG. 1. Seals 29 are also employed to maintain the castings in a liquid tight relation.

Lower main casting 16, impeller sleeve casting 22 and end plate 28 form a first enclosed chamber generally indicated 31 inside of housing 12. First chamber 31 is in fluid connection with the inside of the fuel tank through pump inlet 18.

Lower main casting 16 also incorporates a pump discharge outlet 32. Pump discharge outlet 32 is adapted to be connected to a fuel line (not shown) or other fluid conduit which carries the fuel to the remainder of the aircraft fuel system. Pump discharge outlet 32 is connected to a manifold 34 in the main lower casting 16. Manifold 34 terminates in the casting at a donut shaped high pressure chamber or volute 36 which is located above and at the periphery of impeller 26.

Volute 36 is also connected to a fluid passageway 38 in the lower main pump casting 16. Passageway 38 extends upward from volute 36 and terminates near the top of main pump casting 16. A check valve 40 is mounted at the upper end of passageway 38.

Figure 2:
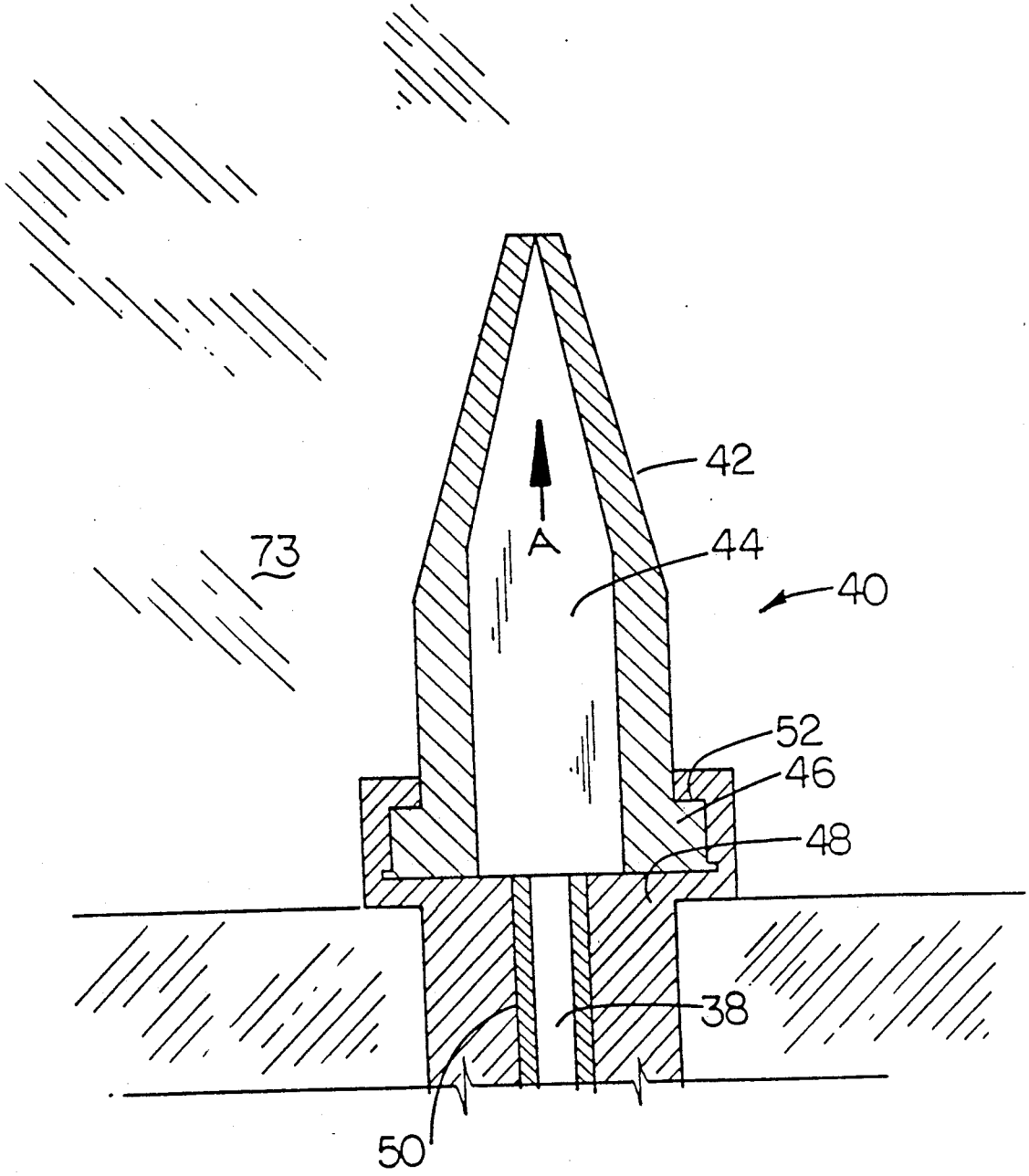
FIG. 2 is a cross sectional view of the check valve portion of the pump shown in FIG. 1.

As shown in FIG. 2, check valve 40 is a "duck bill" style check valve which includes a pair of convergent sides 42 of elastomeric material. Sides 42 enclose an interior portion 44 of the check valve. Due to the elastomeric nature of sides 42, fuel is enabled to flow only in the direction of arrow A in FIG. 2 while flow in the opposed direction is prevented. Although this type of check valve is used in the preferred embodiment, other types of check valves may also be successfully used in the invention. Check valve 40 also includes a circular flange 46 at its lower end.

Passageway 38 is comprised of an outer liner 48 and an inner pipette 50. Outer liner 48 terminates at its upper end in a circular elastomeric snap ring which accepts flange 46 of check valve 40 and hold it in position at the end of the passageway. Pipette 50 has an inside diameter sufficiently small so that it serves as a flame arrestor in the event a fire should occur in the area of housing 12 above the check valve.

Housing 12 also includes a motor enclosure portion 54. Motor enclosure portion 54 is tubular in shape and has a generally hollow interior. A lower end 55 of motor enclosure portion 54 fits into a groove 56 in an upper portion 57 of casting 16. An o-ring 58 is positioned between groove 56 and motor enclosure portion 54 to maintain them in fluid tight relation.

Housing 12 also includes an upper casting 60. Casting 60 includes a groove 62 in a lower face 63. Groove 62 accepts an upper portion 61 of motor enclosure portion 54. An o-ring 64 is positioned in groove 62 and maintains upper casting 60 and motor enclosure portion 54 in fluid tight relation.

Housing 12 also includes a cap 66. Cap 66 incorporates a groove 68 in a lower surface 67 thereof. Groove 68 accepts an upper portion 69 of upper casting 60. An o-ring 70 is used to seal cap 66 and upper casting 60 in a fluid tight manner similar to the other sections of housing 12. Cap 66 also includes a fluid outlet 71 in the upper most portion thereof. Cap 66, upper casting 60 and motor enclosure portion 54 are held to main casting 16 by fastening means represented schematically in FIG. 1 by a stud 72. The fasteners holding the pump housing assembled are not all shown in FIG. 1 to facilitate viewing the parts which comprise the invention. In the preferred form of the invention, stud 72 extends from the cap 66 through the intervening portions of housing 12 and threads into the lower main casting 16. Motor enclosure portion 54, upper casting 60 and cap 66 form a second chamber generally indicated 73, which is in fluid connection with the lower first chamber of the pump through passageway 38.

Rotary electric drive means generally indicated 74 are housed within second chamber 73 of housing 12. Drive means 74 includes a rotatable armature 76. Armature 76 is connected to a shaft 78 which extends into first chamber 31 and upon which impeller 26 is mounted. Armature 76 also includes a pair of commutators 80, one at its upper end and the other at its lower end. Commutators 80 are in electrical connection with motor brushes (not separately shown) which supply electrical current to the armature. The motor brushes are mounted within motor brush support assemblies 88 adjacent to each of the commutators.

Shaft 78 is journaled in a lower bushing 82 at its lower end. Bushing 82 is mounted in main casting 16. A shaft seal 84 is mounted on shaft 78 above impeller 26 to prevent fuel from travelling upward around the shaft.

At the upper end of the armature, shaft 78 is journaled in a bushing 86. Bushing 86 is mounted in upper casting 60. Several fluid holes extend through the upper portion of upper casting 60 and the upper brush support assembly 88 which are represented schematically in FIG. 1 by fluid hole 89. The purpose of these fluid holes is later explained in the discussion of the operation of the pump. Thrust washers (not shown) are also provided on shaft 78 at each end of the armature to hold the armature in its proper position.

Several magnets represented in FIG. 1 by magnet 90 are mounted inside motor enclosure 54 adjacent armature 76 as shown. The magnetic forces applied by magnets 90 in cooperation with the electromagnetic fields generated when armature 76 is supplied with electricity cause armature 76 to rotate. As armature 76 rotates, impeller 26 rotates therewith.

A set of thermal fuses shown schematically in FIG. 1 by thermal fuse 92 are positioned at the vertically uppermost portion of the second chamber inside of cap 66 of housing 12. The thermal fuses pass electricity to the motor brushes which in turn cause armature 76 to rotate. The thermal fuses serve as thermal sensitive electrical conduction means and are designed to pass electricity when the pump temperature is within normal operating ranges. However, when the pump overheats, the temperature of the fuel in the uppermost portion of the housing causes the thermal fuses to "blow" and no longer supply electricity. In the preferred form of the invention, the thermal fuses are of the type made by Elmwood Sensors No. D181-002. These thermal fuses operate the preferred form of the pump at 24 volts DC.

In operation, fuel in the aircraft fuel tank enters the pump housing 12 through inlet 18 and flows by gravity into first fluid chamber 31. Fuel then enters the conical center bore 24 of the impeller sleeve casting 22. Rotation of impeller 26 forces the fuel in the center bore upward into volute 36. Most of the fuel then passes through manifold 34 and out of the pump through discharge 32. Fuel delivered at the discharge is conducted through a fuel line which serves as fluid conduit means for passing fuel to the rest of the aircraft fuel system.

A portion of the fuel delivered at volute 36 flows through passage 38 and check valve 40. This fluid fills chamber 73 where it cools the armature and other components housed therein.

After fuel passes through check valve 40 into the second chamber, it rises in the interior of motor enclosure portion 54. From there the fuel travels upward through fluid holes 89 and into the interior area of cap 66. The fuel flowing over the thermal fuses 92 located inside the cap also serves to keep the fuses cool. From inside cap 66 the fuel flows out of housing 12 through outlet 71 at the top of cap 66. From there the fuel returns to the interior of the tank.

As long as fuel is available at inlet 18, fuel continues to be pumped from the first chamber 31 into the second chamber 73, keeping the pump cool. Typically when an aircraft fuel tank runs out of fuel, fuel is continues to be supplied to the aircraft fuel system by pumps located in other fuel tanks where fuel is still available. Although the tank has run dry, often the fuel pump will continue operating.

Once the fuel in the tank is depleted, fuel is no longer pushed through passage 38 and check valve 40 closes. As a result, fuel that is present when the tank runs out of fuel is held in second chamber 73. The fuel trapped in the second chamber absorbs heat from the components contained therein. As aircraft fuel, such as JP4 which is used in the preferred form of the invention, has considerable heat absorption capability, the pump may run for an extended period of time without overheating. Fuel in second chamber 73 may also become sufficiently hot to vaporize and escape through fluid outlet 71. The vaporized fuel carries away more heat. The pump of the present invention may continue to run indefinitely until the fuel supply is reinstated at inlet 18. However, in the event the pump should be come excessively warm so that damage may result, the thermal fuses will cut off the flow of electricity to the motor brushes and armature.

Thus, the new aircraft fuel pump achieves the above stated objectives, eliminates difficulties encountered in the use of prior devices, solves problems and obtains the desireable results described herein.

In the foregoing description certain items have been used for brevity, clarity and understanding, however, no unnecessary limitations are to be implied therefrom because such terms are for descriptive purposes and are intended to be broadly construed. Moreover, the descriptions and illustrations given are by way of example and the invention is not limited to the exact details shown or described.

Having described the features, discoveries and principles of the invention, the manner in which it is constructed and operated, and the advantages and useful results obtained, the new and useful structures, devices, elements, arrangements, parts, combinations, systems, equipment, operations and relationships are set forth in the appended claims.

I claim:

1. A pump capable of running dry for extended periods without damage, said pump adapted for pumping fluid from a reservoir and delivering fluid at an outlet, comprising:

a pump housing including:

a. a fluid inlet in fluid connection with the reservoir;

b. a fluid outlet;

c. a first chamber in fluid connection with the inlet;

d. a second chamber vertically above said first chamber and in fluid connection with the outlet;

e. a passageway for passing fluid between the first chamber and the second chamber, said passageway having a first end adjacent said chamber and a second end adjacent said second chamber;

rotary electric drive means for driving a shaft, said drive means located in said second chamber and in heat transfer relation therewith, said outlet located vertically above said drive means;

an impeller mounted for rotational movement in said first chamber, said impeller in connection with said shaft, said impeller moving fluid from said inlet to said first end of said passageway upon rotation;

check valve means in said passageway for preventing flow from said second chamber to said first chamber while enabling fluid flow from said first chamber to said second chamber;

whereby when fluid is available at said inlet, said fluid is moved by action of said impeller through said first chamber, through said passageway and through said second chamber, to said outlet, said fluid passing through said second chamber cooling said drive means, and whereby when said fluid is no longer available at said inlet, said check valve means prevents flow downwardly out of said second chamber, said fluid held in said second chamber absorbing heat generated by said drive means to avoid damage to said pump.

2. The pump according to claim 1 and further comprising thermal sensitive electrical conduction means in said pump housing for conducting electricity to said rotary electric drive means when the temperature of said conduction means is below a limit, whereby said conduction means prevents damage to said pump due to overheating.

3. The pump according to claim 2 wherein said conduction means is positioned in said second chamber of said housing in heat transfer relation with said fluid.

4. The pump according the claim 3 wherein said fluid outlet is at a vertically uppermost portion of said second chamber and said conduction means comprises a thermal fuse adjacent said outlet.

5. The pump according to claim 1 wherein said housing is positioned inside a fluid reservoir and said housing further comprises a pump discharge from said first chamber, said discharge in fluid connection with a fluid conduit means; a first portion of said fluid delivered from said first chamber at said discharge and a second portion of said fluid from said first chamber delivered to said second chamber; and wherein said fluid outlet of said second chamber is in fluid communication with said reservoir.

6. The pump according to claim 5 wherein the passageway between said first and second chambers comprises a pipette, whereby said pipette suppresses the transmission of flame between said chambers.

7. The pump according to claim 6 wherein said check valve means comprises a resiliant duck bill check valve positioned at the second end of said pipette.

8. The pump according to claim 7 and further comprising thermal sensitive electrical conduction means in said pump housing for supplying electricity to said rotary electric drive means when the temperature of said conduction means is below a limit, whereby said conduction means prevents damage to said pump due to overheating.

9. The pump according to claim 8 wherein said conduction means is positioned in said second chamber of said housing in heat transfer relation with said fluid.

10. The pump according the claim 9 wherein said fluid outlet is at a vertically uppermost portion of said second chamber and said conduction means comprises a thermal fuse adjacent said outlet.

* * * * *